United States Patent [19]

Frison

[11] Patent Number: 4,619,579

[45] Date of Patent: Oct. 28, 1986

[54] FREE STANDING LIFT TRUCK ATTACHMENT WITH QUICK CONNECTION

[75] Inventor: Emmett Frison, Portland, Oreg.

[73] Assignee: Brudi Equipment Co., Longview, Wash.

[21] Appl. No.: 630,773

[22] Filed: Jul. 13, 1984

[51] Int. Cl.[4] ..... B66F 9/14

[52] U.S. Cl. ..... 414/607; 414/661; 414/912; 187/9 R

[58] Field of Search ..... 414/607, 661, 785, 723, 414/724, 912; 187/9 R

[56] References Cited

U.S. PATENT DOCUMENTS

| | | | |
|---|---|---|---|
| 3,180,513 | 4/1965 | Vander Wal | 414/607 |
| 3,310,189 | 3/1967 | Vander Wal | 414/607 |
| 3,809,264 | 5/1974 | Mayers | 414/293 |
| 3,885,692 | 5/1975 | Anderson, Jr. | 414/660 |
| 4,406,575 | 9/1983 | Gaibler | 414/667 |
| 4,482,286 | 11/1984 | Farmer et al. | 414/607 |

OTHER PUBLICATIONS

Manuel and Parts List for Special Fork Truck Mounted "Slip Sheet Attachment", D. F. Industries, Inc., Jun. 20, 1983, 24 pages.

Brudi Lift Truck Attachments Brochure, Brudi Equipment, Inc., 1974, 4 pages.

Brudi Broke Clamp BCA, Brudi Equipment, Inc., 1984, 2 pages.

Long Reach Load Push Attachment, Long Reach Manufacturing, May 15, 1967, 3 pages.

*Primary Examiner*—Robert J. Spar

*Assistant Examiner*—Ken Muncy

*Attorney, Agent, or Firm*—Klarquist, Sparkman, Campbell, Leigh & Whinston

[57] ABSTRACT

A load-handling attachment for a forklift truck has an upright base including a downwardly open upper hook for engaging the upper crossbar of the truck's load carriage and an upwardly open lower hook for engaging the lower crossbar of such carriage. The lower hook forms part of a hook-and-support assembly. The assembly includes a base from support foot which supports the attachment in an upright free standing condition when the attachment is dismounted from the truck. The lower hook and foot move together between operative and inoperative positions when activated so that when the foot is moved to its supporting position, the lower hook disengages the load carriage to enable the truck to disengage the attachment.

12 Claims, 6 Drawing Figures

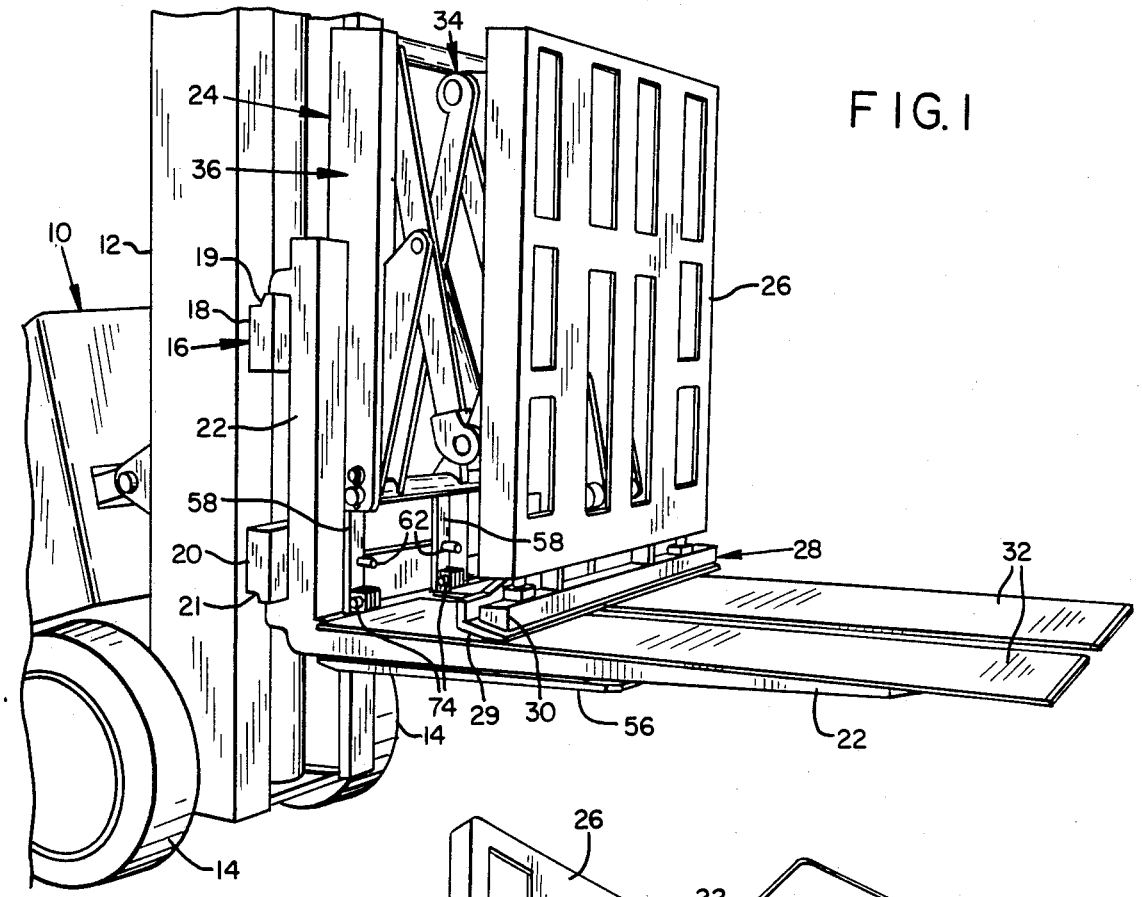
FIG. 1
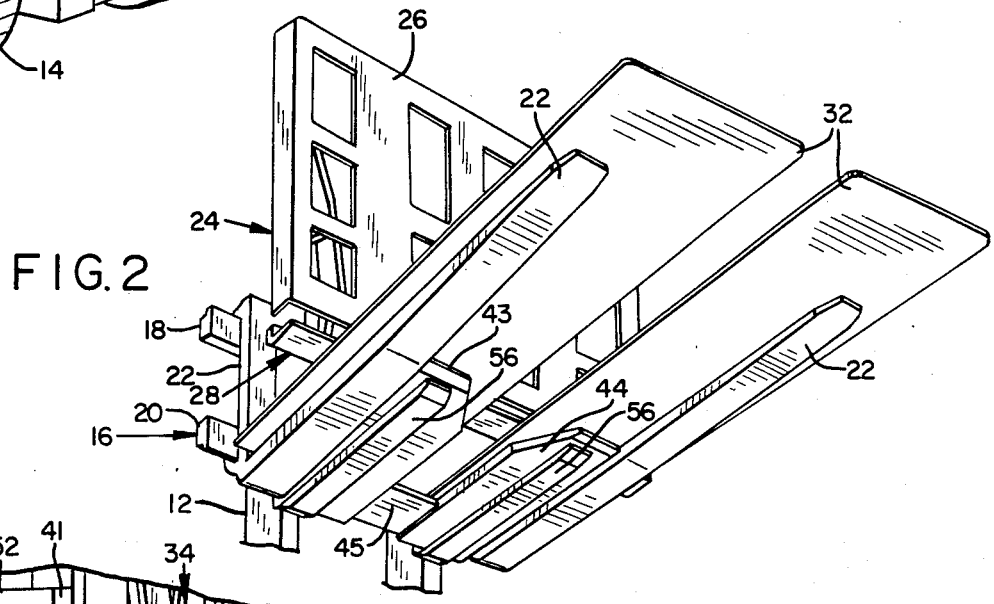
FIG. 2
FIG. 3
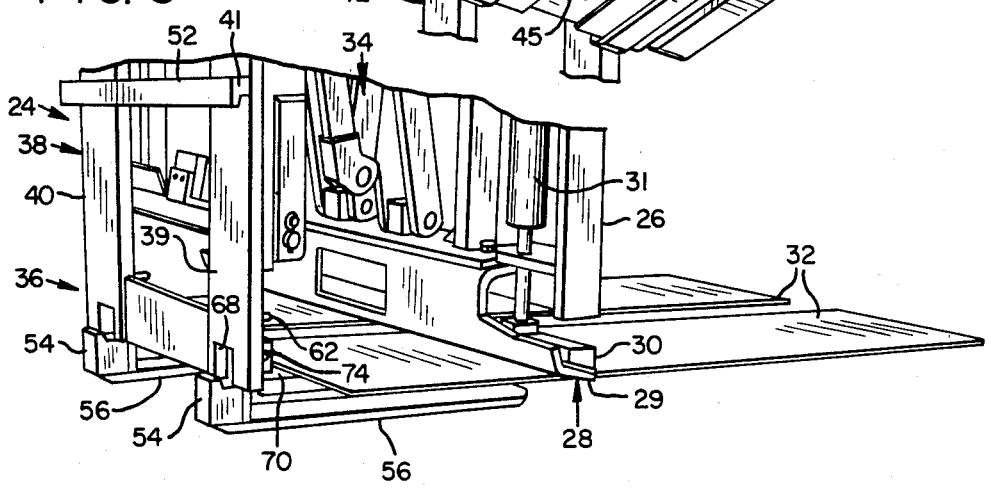

FREE STANDING LIFT TRUCK ATTACHMENT WITH QUICK CONNECTION

BACKGROUND OF THE INVENTION

This invention relates to load-handling attachments for forklift trucks and more specifically to the means for engaging and disengaging an attachment from the truck and for supporting the attachment when disengaged.

The use of specialized load-handling attachments on lift trucks instead of or in conjunction with conventional lifting forks, such as push-pull attachments or side shifters, is well known in the industry. Such attachments are typically adapted for mounting on conventional ITA (Industrial Truck Association) hook-type lift truck carriages. One attachment so adapted is shown in U.S. Pat. No. 4,165,008.

Two problems in the use of attachments for forklift trucks are the time lost and inconvenience involved in engaging and disengaging such attachments from a truck. Typically, to connect an attachment to a truck, the truck operator must at least drive the truck to a storage area where the attachment is stored upright on a special stand, adjust the level of the load carriage of the truck so that its upper crossbar is below the level of the downwardly opening upper hook of the attachment, drive the truck to position the carriage against the attachment, elevate the carriage until its upper crossbar engages the upper hook, stop the truck, get out of the truck, connect the hydraulic hoses of the attachment to those of the truck, connect an upwardly directed lower hook of the attachment to a lower crossbar of the carriage, get back in the truck, raise the attachment from its stand and drive back to the work area.

A partial solution to the foregoing problems is the use of quick connect-disconnect lower hooks on the attachment which swing into and out of engagement with the lower crossbar of the load carriage. Such lower hooks are disclosed, for example, in a brochure entitled "Cascade QFM Push/Pull (Quick Fork Mount)," published by Cascade Corporation of Portland, Oreg. While the use of such lower hooks does save some time in mounting and dismounting the attachment, it does not eliminate a major source of lost time in such operations, namely, driving to and from the attachment storage area.

The drive to and from the attachment storage area is necessitated because the attachments are not self-supporting in an upright position ready for use. To support the attachments in such a position requires the use of special stands which are kept in such storage areas out of the way of normal lift truck operations and where they can be readily found when needed.

Accordingly, there is still a need to reduce the time and inconvenience involved in mounting and dismounting attachments from forklift trucks.

It is, therefore, a primary objective of the present invention to reduce the time and inconvenience of mounting and dismounting attachments from lift truck load carriages by eliminating the need for storing such attachments on special stands remote from the work area when detached from the lift truck, thereby eliminating time lost in driving to and from the work area in mounting and dismounting such attachments.

A more specific object of the invention is to provide a lift truck attachment which is free standing when detached from a lift truck.

Another major objective is to provide a lift truck attachment which is both free standing and quickly attachable to and detachable from a lift truck.

SUMMARY OF THE INVENTION

The invention is an improved load-handling attachment for the front end of a forklift truck having a mast and a conventional ITA hook-type load carriage which fulfills the foregoing objectives.

The attachment features quick locking and release lower hooks to facilitate fast and easy mounting and dismounting of the attachment, and support means for supporting the attachment in a free standing condition when detached from a lift truck to eliminate the need for a support stand.

According to another aspect of the invention, the quick lock-release feature and free standing feature may be cooperative so that the lift truck operator can engage and lock the lower hooks and retract the free standing support at the same time, or release the lower hooks and move the free standing support to its operative position at the same time, thereby simplifying and speeding up even further, the mounting and dismounting functions.

According to a preferred embodiment of the invention, the foregoing features are embodied in a push-pull attachment which is adapted for mounting on a standard ITA hook-type load carriage while the load forks remain attached to such carriage. In such embodiment, the free standing support means may comprise a pair of support feet extending forwardly from the upright base of the attachment and movable vertically between an operative position below the level of the forks and a retracted position at or above the level of the forks. Also in such embodiment the lower hooks may be movable vertically with the support feet through attachment of each lower hook and foot to a common slide member.

The foregoing and other objects, features and advantages of the invention will become more apparent from the following detailed description, which proceeds with reference to the accompanying drawings.

BRIEF DESCRIPTION OF THE DRAWINGS

FIG. 1 is a perspective view showing the front portion of a lift truck with an attachment in accordance with the invention mounted to its load carriage, as viewed from the side and front;

FIG. 2 is a perspective view of a front portion of the lift truck of FIG. 1 showing the attachment elevated on the lift truck mast, as viewed from below the attachment;

FIG. 3 is a partial perspective view of the attachment of FIGS. 1 and 2 detached from the lift truck;

DETAILED DESCRIPTION OF A PREFERRED EMBODIMENT

Figure 4:
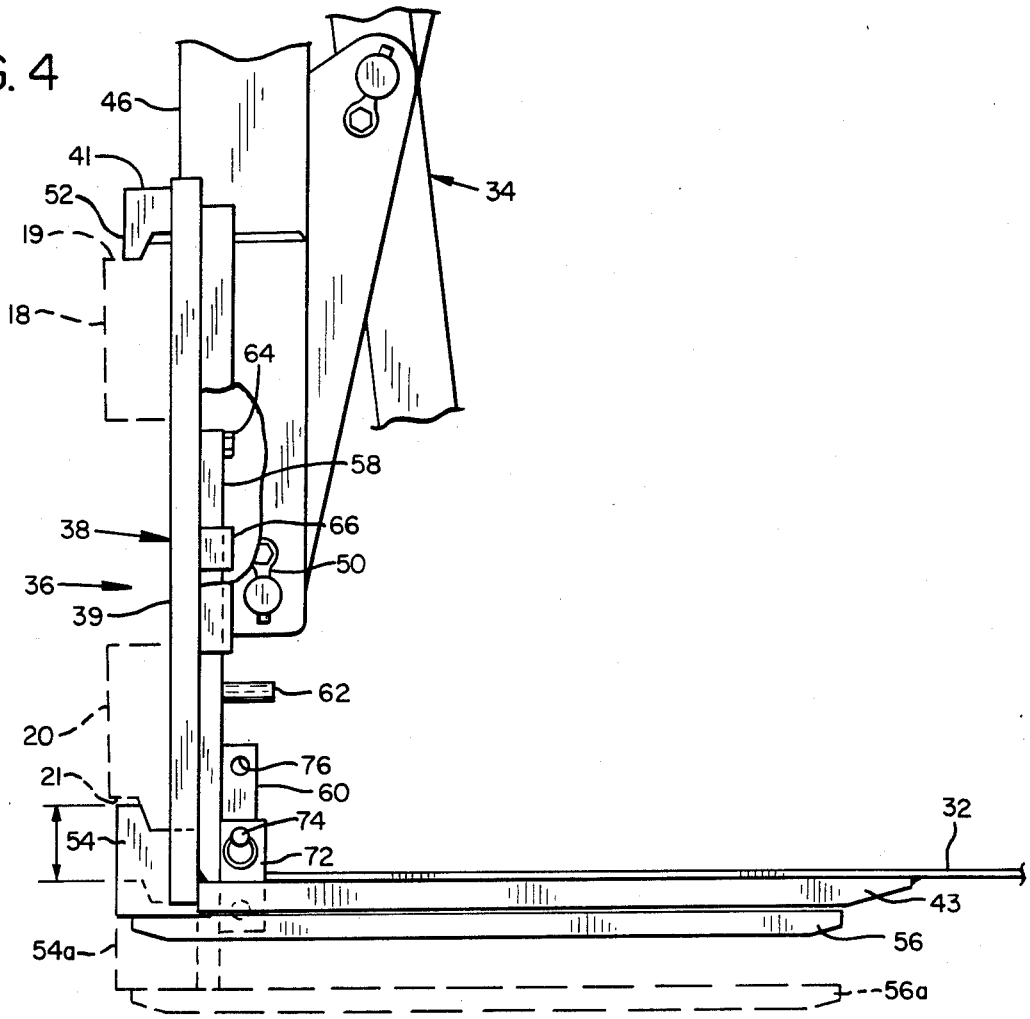
FIG. 4 is a side elevational view of the attachment of FIGS. 1–3 with parts broken away and showing in broken lines a lower hook in its disengaged position and support foot in its supporting position.

With reference first to FIGS. 1 and 2 of the drawings, the front end of the forklift truck 10 includes an upright mast 12 mounted between wheels 14. The mast mounts in the usual manner a load carriage 16 for movement along the mast. Carriage 16 is of the conventional ITA hook-type, and includes an upper horizontal crossbar 18 and a lower horizontal crossbar 20 interconnected by structural support members (not shown). Upper crossbar 18 is notched at 19, and lower crossbar 20 is notched at 21 to receive the upper and lower hook portions of a conventional pair of load forks 22 and corresponding hook portions of a variety of load-handling attachments which may be mounted on the carriage.

The illustrated load-handling attachment 24 is commonly referred to in the industry as a push-pull attachment. It conventionally includes a push plate 26 carrying a lower gripper mechanism 28 including a stationary lower jaw 29 and movable upper jaw 30, the latter operated by hydraulic cylinders 31, one of which is shown in FIG. 3. Push plate 26 is movable forwardly and rearwardly over a pair of platens 32 by a hydraulically operated pantograph mechanism 34 anchored to a base frame 36 of the attachment. The push plate is used to push loads from the platens. The gripper jaws are used to pull loads stacked on an underlying so-called "slip sheet," onto the platens by gripping a free end of the slip sheet and retracting the push plate. Because the push-pull mechanism is only exemplary of several different mechanisms which can form part of the basic attachment, it need not be described in further detail and is omitted wholly or partially in several of the drawings.

Figure 5:
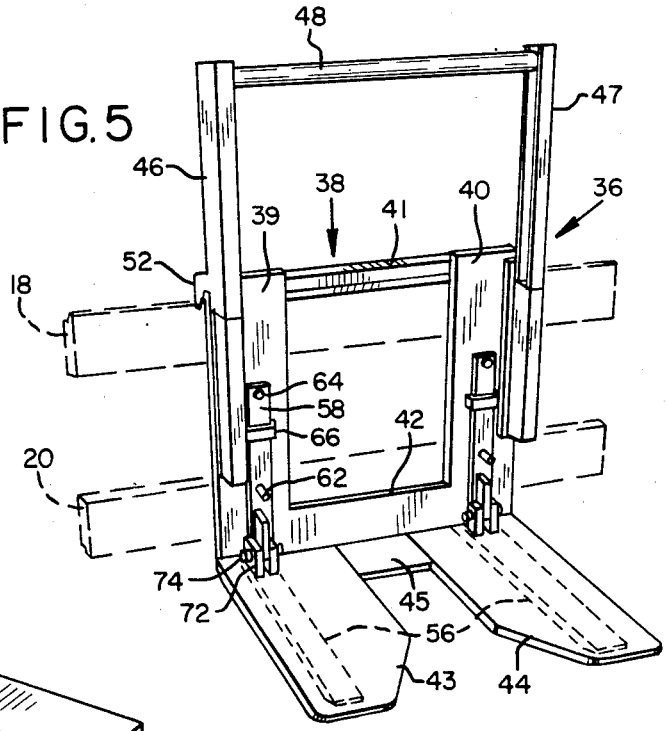
FIG. 5 is a front perspective view of the attachment of FIGS. 1–4 with load-handling parts removed for clarity.

The base frame 36 of the attachment, which mounts the load-handling mechanism, is shown best in FIGS. 4 and 5. Such frame includes an upright base 38 formed by a pair of upright side frame members 39, 40 joined by top and bottom cross frame members 41, 42. A pair of spade members 43, 44 extend forwardly from the lower end of upright base 38, reinforced by a gusset plate 45. Spade members 43, 44 provide the basic underlying support and attachment for platens 32, supplemented by load forks 22 (see FIGS. 1 and 2).

Base 38 includes a pair of upper extension members 46, 47 welded at their lower ends to upright frame members 39, 40 and joined at their upper ends by a top crossbar 48. These extensions mount the pantograph mechanism 34 of the push-pull assembly at pin connections, one of which is shown at 50 in FIG. 4.

Base 38, and thus the entire attachment 24, is mounted on carriage 16 by hook means on the base. Such hook means, shown best in FIGS. 3 and 4, include the top cross frame member 41 of the base, the rearward portion of which forms a downwardly opening upper mounting hook 52. This hook is adapted to engage the notched portion 19 of upper carriage crossbar 18. The hook means also include a pair of upwardly opening lower mounting hooks 54 for engaging the notched portion 21 of lower carriage crossbar 20. The lower hooks are vertically movable, in a manner to be described, to selectively engage and disengage the lower crossbar 20 and thereby enable quick and easy mounting and dismounting of the attachment from the carriage.

The base frame 36, including upright base 38 and forwardly extending spades 43,44, is narrow in its overall width dimension so that the lift truck's load forks 22 can remain on its load carriage 16 and straddle the base frame while the attachment is also mounted on the carriage. This relationship of forks and base frame will be apparent from FIG. 2. However, the load carrying platens 32 and push plate 26 are wider than base frame 36, and the forks are used to help the spades 43,44 support the platens. With this arrangement, the operative components of the push-pull attachment can be of normal width although the base frame 36 is narrower than that of conventional push-pull attachments.

Figure 6:
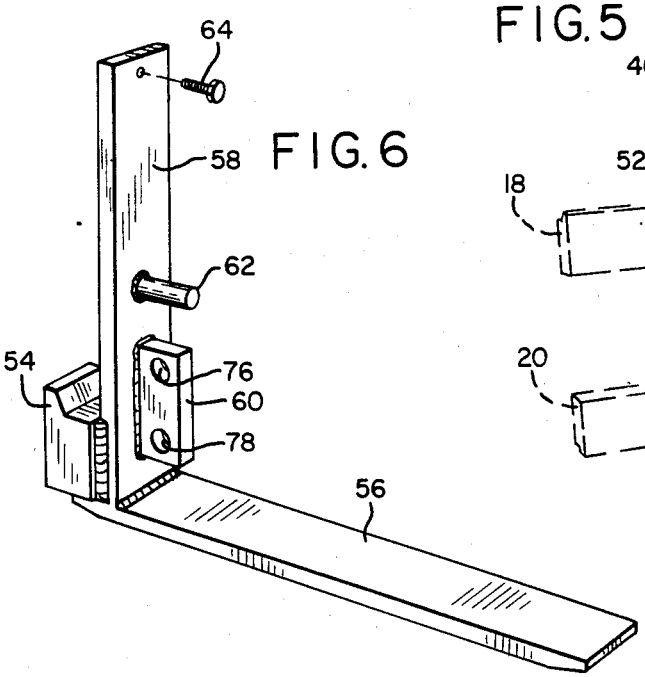
FIG. 6 is a perspective view of a combined support foot and lower hook assembly of the attachment of FIGS. 1–5.

Each lower hook 54 is a unitary part of one of a pair of assemblies which combine a quick connect-disconnect feature of the attachment with a free standing feature. Referring to FIG. 6, each such assembly includes, in addition to lower hook 54, a base frame support means in the form of a forwardly extending flat support foot 56. Both hook 54 and foot 56 are welded to an upright slide bar 58, so that vertical movement of the bar, whether up or down, moves both the hook and the foot in the same direction and to the same extent. Slide member 58 mounts a forwardly projecting locking ear 60 near its lower end, a positioning handle bar 62 between its upper and lower ends, and a locator stop screw 64 threaded into an opening near its upper end. Thus the hook, foot and slide bar together define a unitary, rigid, and generally right angular hook and support assembly, which is mounted on the base frame for vertical movement relative to such frame.

Now referring to FIGS. 4 and 5, the slide bar 58 of each hook-and-support assembly is slidably mounted to the front face of an upright base frame member 39 or 40 by a mounting sleeve 66 for vertical movement. A slot 68 (see FIG. 3) in the lower end of each upright base frame member 39, 40 and second slot 70 at the rear end of each spade 43,44 accommodates such vertical movement. The upper limit of travel of each hook-and-support assembly is determined by abutment of the upper surface of its support foot 56 with the lower surface of the associated spade 43, 44. The lower limit of travel of each assembly is determined by abutment of its locator stop screw 64 with its mounting sleeve 66.

Locking means are provided to lock each hook-and-support assembly in either a lowered, extended position, shown at 54*a*, 56*a* in FIG. 4, or in a raised, retracted position, shown at 54, 56 in FIG. 4. Such means include, in addition to locking ear 60 of slide bar 58, a pair of laterally-spaced ears defining a clevis 72 at the inner end of each spade 43,44, and a locking pin 74 for insertion through aligned positioning holes in each clevis and locking ear. As shown in FIG. 6, each locking ear 60 includes an upper locking hole 76 which determines the lowered, operative position of foot 56 and the lowered, release position of lower hook 54. Each locking ear 60 also includes a lower locking hole 78 which determines the raised, inoperative position of foot 56 and the raised, engaged position of hook 54. These positions of foot and lower hook are achieved when either the upper hole 76 or lower hole 78 of locking ear 60 is aligned with the single set of through holes in the associated clevis 72 within which ear 60 slides. In FIG. 4, for example, foot 56 and lower hook 54 are shown locked in their raised positions, with the hook engaged with lower crossbar 20 and the foot inoperative.

OPERATION

To mount the free standing attachment to a lift truck, the truck with forks attached approaches the rear of the attachment. The forks straddle base frame 36 at an elevation below platens 32. This position upper crossbar 18 of the truck's load carriage below upper hook bar 52 of the attachment. When the carriage abuts the rear of upright base 38, the carriage is elevated until upper crossbar 18 engages upper hook bar 52 and forks 22 engage the undersurface of platens 32 alongside spades 43,44. Elevation of the carriage continues until the attachment is fully supported on it and feet 56 clear the floor.

At this point, the truck operator leaves his truck, grasps handle 62 and pulls locking pin 74 from the upper hole 76 of locking bar 60 of one hook-and-support assembly. He then pulls up on handle 62 to raise the assembly and inserts locking pin 74 through clevis 72 and lower hole 78 of the locking bar, thereby simultaneously engaging lower hook 54 with lower crossbar 20 of the truck carriage and retracting support foot 56 to an out-of-the-way position. The same procedure is repeated with the other assembly, engaging its lower hook and retracting its support foot at the same time. Hydraulic hoses on the truck are coupled to corresponding hoses or manifolds on the attachment to complete the mounting procedure.

To dismount the attachment from the carriage, the foregoing procedure is reversed. Before leaving his truck to pull the locking pins 74, the operator should extend push plate 26 slightly from base 38 to provide access to the pins and lift handles of the locking assemblies and to shift the center of gravity of the attachment forward for improved balance when free standing on feet 56. After feet 56 and lower hooks 54 have been lowered and locked in their lowered positions, the operator simply returns to his truck controls, lowers carriage 16 until the attachment is fully supported on feet 56 and disengaged from forks 22 and upper crossbar 18, then backs the truck away from the attachment.

Although the combined quick connect-disconnect lower hook means and base support means have been described as embodied in a specific type of push-pull attachment, it will be apparent that the same means may be incorporated in other push-pull attachments of more conventional designs, in pusher-type attachments, and in other types of attachments that do not employ platens. It should also be apparent that the various mounting and dismounting functions described could be automated, if desired.

Having illustrated and described the principles of my invention by what is presently a preferred embodiment thereof, it should be apparent to persons skilled in the art that such embodiment may be modified without departing from such principles. It is my intention to claim as my invention, my illustrated embodiments and all such modifications and equivalents as come within the true spirit and scope of the following claims.

I claim:

1. A load-handling attachment for the front end of a forklift truck having a mast and a load carriage movable along the mast, the attachment comprising:

an upright base frame including connecting means for connecting said attachment to the load carriage, and means for disengaging said connecting means from said carriage to enable detachment of the attachment from the lift truck;

base frame support means for supporting said base frame in an upright free-standing position over an underlying support surface while detached from a lift truck; and support mounting means for mounting said support means to said base frame for linear sliding movement between a lowered base frame supporting ground-engaging position and a raised retracted position and for locking the support means in said positions, said support means including a ground-engaging portion extending rearward to at least the upright rear face of the base frame in said ground-engaging position to provide ground support rearward of said mounting means and thereby resist rearward tipping of the base frame when free standing.

2. An attachment according to claim 1 wherein the base frame support means includes a pair of elongated, ground-engaging horizontal feet projecting forwardly and rearwardly of said mounting means for supporting said attachment on said underlying support surface with the base frame spaced above the underlying support surface to enable insertion of forks of a forklift truck horizontally therebeneath.

3. A load-handling attachment for the front end of a forklift truck having a mast and a load carriage movable along the mast, the attachment comprising:

an upright base frame including lower hook means for engaging the carriage to connect said attachments to the forklift truck;

hook mounting means mounting said lower hook means to said base frame for movement between engaged and disengaged positions with respect to the carriage and for locking said lower hook means in said positions;

base frame support means for supporting said base frame in an upright free-standing position on an underlying support surface while detached from a lift truck; and support mounting means for mounting said support means to said base frame for movement between a base frame supporting position and a retracted position and for locking the support means in said positions;

said support means including an elongated support foot, said hook mounting means and said support mounting means comprising a common slide means for linearly moving said foot and lower hook means together between respective raised and lowered positions, and locking means cooperative with said slide means for selectively locking said foot and lower hook means in their respective raised and lowered positions.

4. In a load-handling attachment for the front end of a forklift truck having a mast and a load carriage movable along the mast, the carriage including removable laterally spaced load forks, the improvement comprising:

an upright base frame for the attachment including hook means for engaging the carriage to connect the attachment to the carriage with its forks in place, hook mounting means for mounting said hook means to said base frame for linear sliding movement between engaged and disengaged positions relative to the carriage and for selectively locking said hook means in said positions to connect or disconnect said attachment from said carriage;

base frame support means for supporting said base frame in an upright free-standing position on an underlying support surface while detached from said truck; and support mounting means for mounting said base frame support means to said base frame for linear sliding movement of said support means between a supporting position and a retracted position and for selectively locking said support means in each said position, said base frame support means comprising a foot means positioned laterally offset from said forks.

5. An attachment according to claim 4 wherein said hook mounting means and said support mounting means include common means operable to move said hook means to its disengaged position and move said base frame support means to its supporting position simultaneously.

6. An attachment according to claim 5 wherein said hook mounting means and said support mounting means include common locking means for locking said lower hook means and said base frame support means in their respective positions.

7. An attachment according to claim 4 wherein said hook mounting means and said support mounting means comprise common means slidable linearly in a general vertical direction along said base frame to engage and disengage said hook means and simultaneously move said foot means between its retracted and supporting positions, said foot means including an underlying surface-engaging support portion positioned rearward of said common means when said foot means is in its supporting position.

8. An attachment according to claim 7 wherein said surface-engaging support portion extends forward and rearward of said common means to support said base frame in a position substantially normal to the underlying surface and spaced above said surface.

9. An attachment according to claim 7 wherein said support portion extends forward and rearward of the upright front face of the base frame.

10. An attachment according to claim 7 wherein the support portion is positioned rearward to at least the upright rear face of the base frame.

11. An attachment according to claim 7 wherein said foot means includes a foot portion extending rearward of said common means and beyond the rearmost upright face of the base frame.

12. An attachment according to claim 7 wherein said base frame comprises a pair of laterally opposed upright side frame members, said foot means comprises a pair of support feet one adjacent each side frame member, and said common means comprises a pair of slide bars one slidable vertically along each side frame member and lockable in at least two different positions vertically along said side frame member, said hook means comprising a pair of carriage-engaging hook members one carried by each support foot.

* * * * *